US012492505B2

(12) United States Patent
Zadro et al.

(10) Patent No.: US 12,492,505 B2
(45) Date of Patent: Dec. 9, 2025

(54) FABRIC ARTICLE WARMER AND DRYER

(71) Applicant: Zadro, Inc., Huntington Beach, CA (US)

(72) Inventors: Zlatko Zadro, Huntington Beach, CA (US); Elizabeth Zadro, Huntington Beach, CA (US)

(73) Assignee: Zadro, Inc., Huntington Beach, CA (US)

( * ) Notice: Subject to any disclaimer, the term of this patent is extended or adjusted under 35 U.S.C. 154(b) by 728 days.

(21) Appl. No.: 17/936,774

(22) Filed: Sep. 29, 2022

(65) Prior Publication Data

US 2024/0110326 A1 Apr. 4, 2024

(51) Int. Cl.

| | |
|---|---|
| ***D06F 58/10*** | (2006.01) |
| ***A47K 10/48*** | (2006.01) |
| ***D06F 58/26*** | (2006.01) |

(52) U.S. Cl.
CPC ..... *D06F 58/10* (2013.01); *A47K 10/48* (2013.01); *D06F 58/26* (2013.01)

(58) Field of Classification Search
CPC ..... D06F 58/10; D06F 58/26; D06F 58/14; A47K 10/48
See application file for complete search history.

(56) References Cited

U.S. PATENT DOCUMENTS

| | | | | |
|---|---|---|---|---|
| 2,253,475 | A * | 8/1941 | Willber | D06F 58/14 312/297 |
| 3,023,514 | A * | 3/1962 | Gibson | D06F 58/10 219/400 |
| 4,117,309 | A | 9/1978 | Cayley | |
| 4,644,136 | A | 2/1987 | Watchman | |
| 4,849,610 | A | 7/1989 | Alvarez | |
| 4,927,995 | A | 5/1990 | Lovett | |
| 5,369,892 | A * | 12/1994 | Dhaemers | F26B 21/00 34/224 |
| 5,569,403 | A | 10/1996 | Swanson | |
| 5,842,287 | A | 12/1998 | Murphy | |
| 6,005,227 | A | 12/1999 | Pappas | |
| 6,046,436 | A | 4/2000 | Hunts | |
| 6,525,298 | B1 | 2/2003 | Hunts | |
| 6,604,942 | B2 | 8/2003 | Sharp | |
| 6,667,464 | B2 | 12/2003 | Ellis | |
| 6,840,589 | B2 | 1/2005 | Uri | |

(Continued)

*Primary Examiner* — Edelmira Bosques
*Assistant Examiner* — Bao D Nguyen
(74) *Attorney, Agent, or Firm* — UltimatEdge IP Law Group, P.C.; Dean G. Stathakis

(57) ABSTRACT

A fabric article warmer and dryer is disclosed and includes a fabric article receptacle with a heated air inlet and an opening to the fabric article receptacle delineated by a rim, a lid selectively covering the opening in a closed configuration, and a forced heated air unit providing a flow of heated air to the heated air inlet and into the fabric article receptacle. The present fabric article warmer and dryer includes one or both of a fabric article hanger being positioned above the rim in at least an open configuration and a protruded portion protruding from a bottom wall of the fabric article receptacle into the fabric article receptacle with the heated air inlet being formed therethrough. A fabric article is placed therewithin, with the lid on, in a heating process and is hooked to the fabric article hanger, with the lid opened, in a drying process.

16 Claims, 5 Drawing Sheets

(56) References Cited

U.S. PATENT DOCUMENTS

| | | | |
|---|---|---|---|
| 6,982,399 | B1 | 1/2006 | Hunts |
| 7,161,120 | B1 | 1/2007 | Stroud |
| 7,171,761 | B1 | 2/2007 | Hunts |
| 7,377,052 | B2 | 5/2008 | Maruca |
| 8,058,588 | B2 | 11/2011 | Gagas |
| 8,143,553 | B2 | 3/2012 | DeFranco |
| 8,314,367 | B2 | 11/2012 | Gallo |
| 8,481,895 | B2 | 7/2013 | Taylor |
| 9,326,325 | B2 | 4/2016 | Lev |

* cited by examiner

FABRIC ARTICLE WARMER AND DRYER

BACKGROUND

The subject of this patent application relates generally to towel warmers, and more particularly, to towel warmer containers for warming and drying towels or other fabric articles.

Towels and similar articles are frequently employed by individuals for a variety of purposes, most notably including removing water from the surface of an individual's body following, for example, showering, bathing, swimming, using a hot tub, or other bodily contact with water. An unpleasant or undesirable complication frequently associated with drying off after such bodily contact with water is the well-known chilling effect. Such chilling effect occurs primarily because of exposure to a colder ambient environment upon exiting the water due to the disparity between the ambient temperature and the water temperature as well as the evaporation of water from the body due to the capacity of the skin surface to act as a heat conductor.

Although the rapid drying of the individual after exiting the water can reduces the discomfort many individuals experience, the use of a warmed towel is superior to offset this chilling effect. For example, the feel of a warm towel against the skin immediately after exiting water is a pleasurable experience and eases the transition from the warmer water temperature to the cooler ambient temperature. In addition to being a creature comfort in the modern world, a warmed towel can have therapeutic and medicinal value. Numerous circumstances arise, especially in cold environments, where a warmed towel can be an important factor in the well-being, health or survival of individuals who may be frail or under medical treatment, and thus vulnerable to thermal shock during the drying off period.

Towel warmers are useful to warm and/or dry towels and other fabric articles to enhance comfort and safety of the individual after exiting the water. Towel warmers traditionally come in two different designs. The first design is a warming rack that depend on horizontal heating bars to warm a towel or other fabric article. However, one problem associating with warming racks is that the towel or other fabric article is ineffectively heated. Typically, only a small portion of the article physically contacts the heating bars resulting in only 10% of the article surface area being heated via the bars while the remaining portions are only slowly warmed through thermal air gradients. Other disadvantages of warming racks include invasive structural room modifications to accommodate the warming rack, leading to undesired expense and renovation and high energy consumption for low efficiency heating.

The second designs is a warming container with an opening door that depends on a sealed interior compartment to warm a towel or other fabric article. While such design addresses the some of the problems associate with warming racks, warming containers are not without their own disadvantages. One significant problem with warming containers is the inability to effectively remove moisture from the sealed interior compartment during operation. As such, the towel or other fabric article remains damp and results in a warm, damp article for next use providing an unsatisfactory feel and discomfort by the individual. More importantly, such dampness in conjunction with the warm environment of the sealed interior compartment and lack of fresh air circulation therein creates an environment that encourages growth of bacteria, mold, mildew and/or other microbial pathogens during use. Such microbial growth can have a negative impact not only to the user in terms of odors and health risks to the user but also be detrimental to indoor air quality of the room or premises at large.

Thus, while a variety of towel warming devices have been commercially developed and offered to the public, these towel warmers suffer from one or more disadvantages. Therefore, there exists a need for a towel warmer that provides even and uniform surface that delivers total warming to a towel or other fabric article as well as provides adequate moisture removal in order to produce a warm dry article. Aspects of the present invention fulfill these needs and provide further related advantages as described herein.

SUMMARY

Aspects of the present invention teach certain benefits in construction and use which give rise to the exemplary advantages described below.

The present specification discloses a fabric article warmer and dryer having a fabric article receptacle with a heated air inlet and an opening to the fabric article receptacle delineated by a rim, a lid selectively covering the opening in a closed configuration, and a forced heated air unit providing a flow of heated air to the heated air inlet and into the fabric article receptacle. In one or more embodiments, the present fabric article warmer and dryer includes one or both of a fabric article hanger being positioned above the rim in at least an open configuration and a protruded portion protruding from a bottom wall of the fabric article receptacle into the fabric article receptacle with the heated air inlet being formed therethrough.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Figure 1:
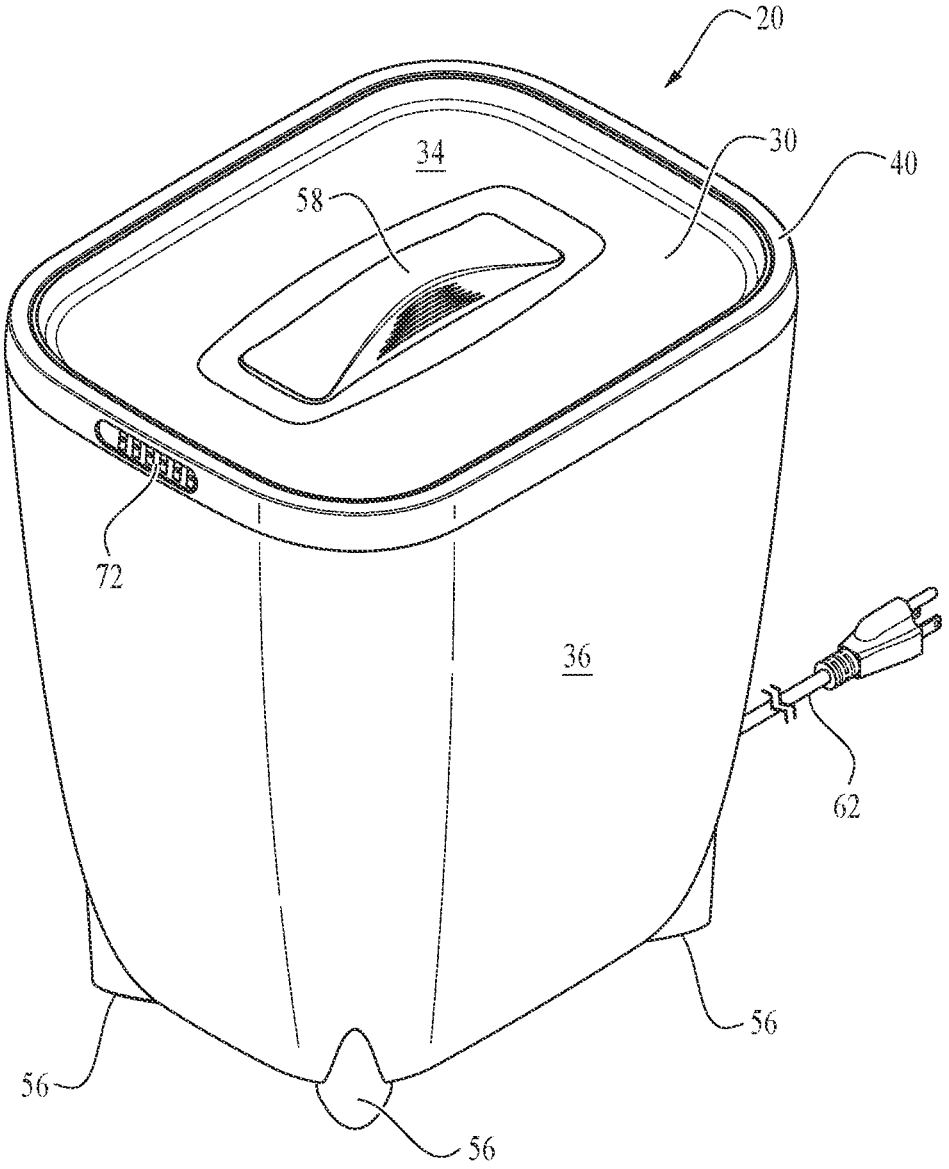
FIG. 1 is an assembled top perspective view of an exemplary embodiment of a warmer and dryer of a fabric article disclosed herein, with the lid on in a closed configuration.

Listing of Reference Numbers Associated with Drawings

| Ref. No. | Element |
|---|---|
| 20 | Fabric article warmer and dryer |
| 22 | Fabric article receptacle |
| 24 | Forced heated air unit |
| 26 | Protruded portion/dome |
| 28 | Fabric article hanger |
| 30 | Lid |
| 32 | Inner surface of the lid 30 |
| 34 | Outer surface of the lid 30 |
| 36 | Outer shell |
| 38 | Inner shell |
| 40 | Rim |
| 42 | Opening within rim 40 |
| 44 | Air passage |
| 46 | Heated air inlet of the inner shell 38 |
| 48 | Heated air outlet of the inner shell 38 |
| 50 | Bottom wall of the inner shell 38 |
| 52 | Side wall of the inner shell 38 |
| 54 | Fresh air inlet of the outer shell 36 |
| 56 | Foot of the inner shell 38 |
| 58 | Handle of the lid 30 |
| 60 | Bracket |
| 62 | Power Cord |
| 64 | Heating element of the forced heated air unit 24 |
| 66 | Fan unit of the forced heated air unit 24 |
| 68 | Control circuitry for the forced heated air unit 24 |
| 70 | Control cable for the forced heated air unit 24 |
| 72 | Control panel for the forced heated air unit 24 |
| 74 | Channel |
| 76 | Channel |
| H | Heated air flow |
| F | Fresh air |
| T | Fabric article/Towel |

DETAILED DESCRIPTION

The present specification discloses a fabric article warmer and dryer, and includes a fabric article receptacle with a heated air inlet and an opening to the fabric article receptacle delineated by a rim, a lid selectively covering the opening in a closed configuration, and a forced heated air unit providing a flow of heated air to the heated air inlet and into the fabric article receptacle. The present fabric article warmer and dryer includes one or both of a fabric article hanger being positioned above the rim in at least an open configuration and a protruded portion protruding from a bottom wall of the fabric article receptacle into the fabric article receptacle with the heated air inlet being formed therethrough. A fabric article is placed therewithin, with the lid on, in a heating process and is hooked to the fabric article hanger, with the lid opened, in a drying process. In this way, instead of the fabric article remaining damp as it is warmed in the sealed receptacle after bathing, it can be hung within the stream of the heated air flow, speeding the drying process, and selectively enclosed in the fabric article receptacle in a warming process.

Figure 2:
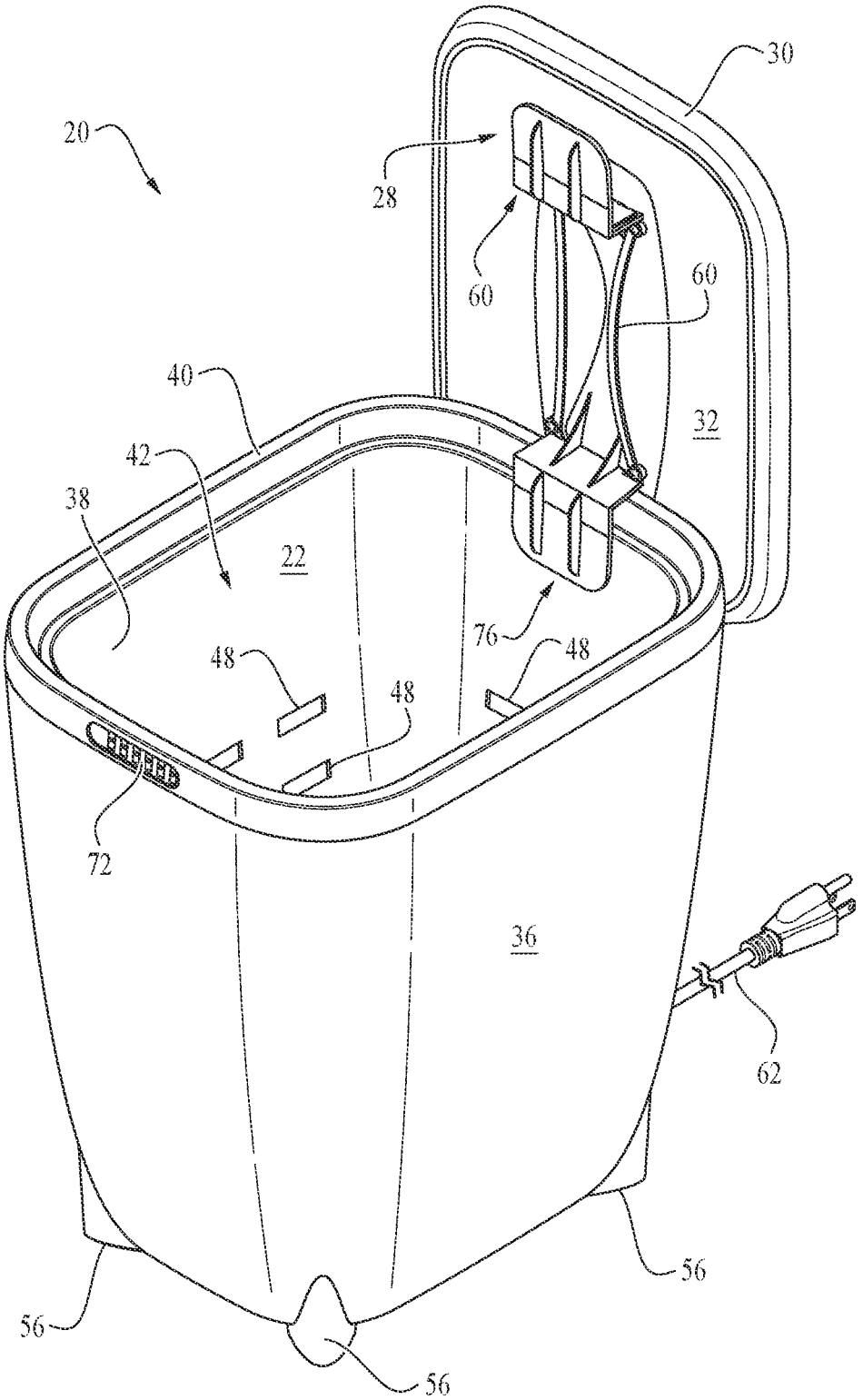
FIG. 2 is an assembled top perspective view of the warmer and dryer of FIG. 1, with the lid on in an open configuration.
Figure 3:
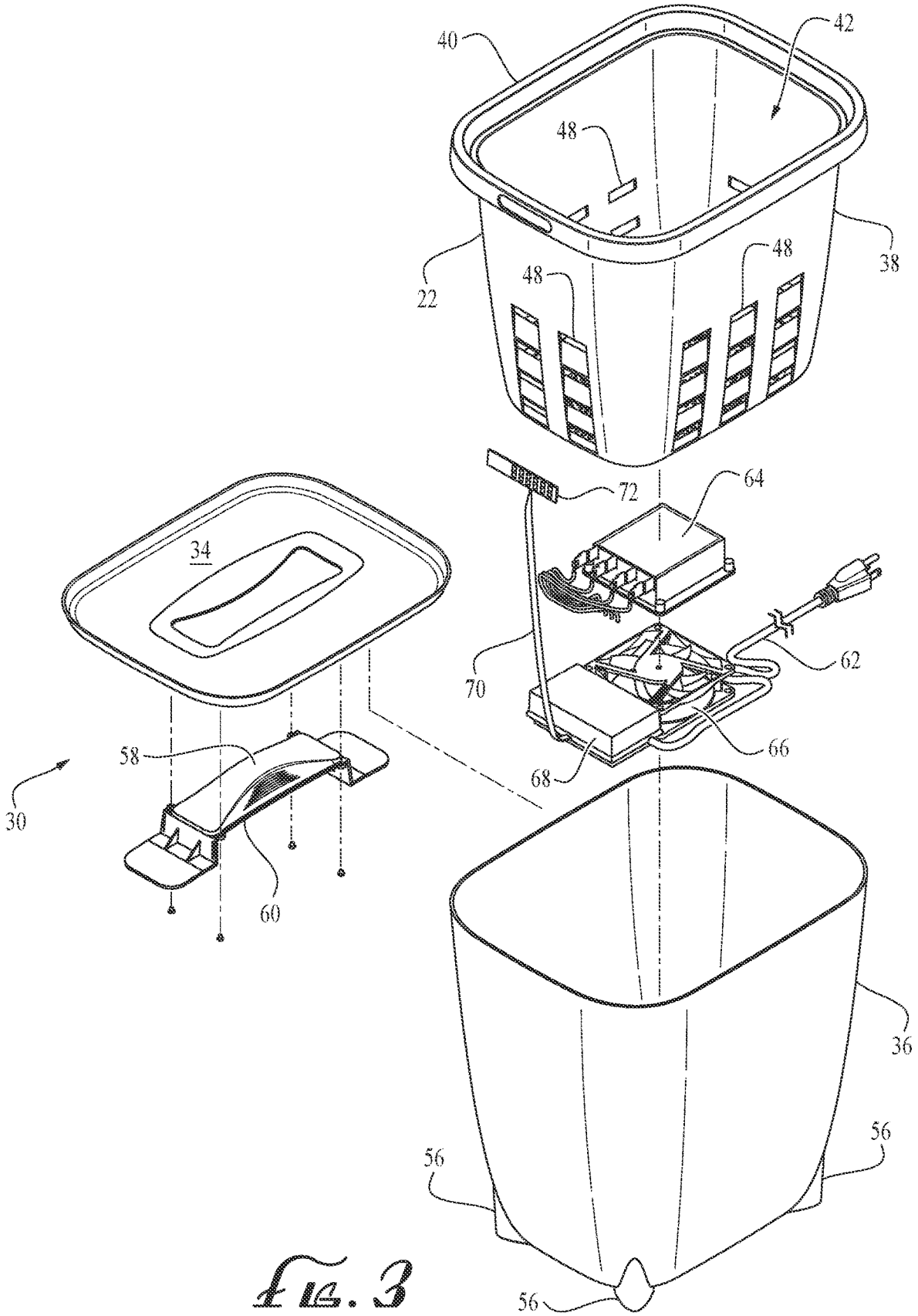
FIG. 3 is an exploded perspective view of the warmer and dryer of FIG. 1.
Figure 4:
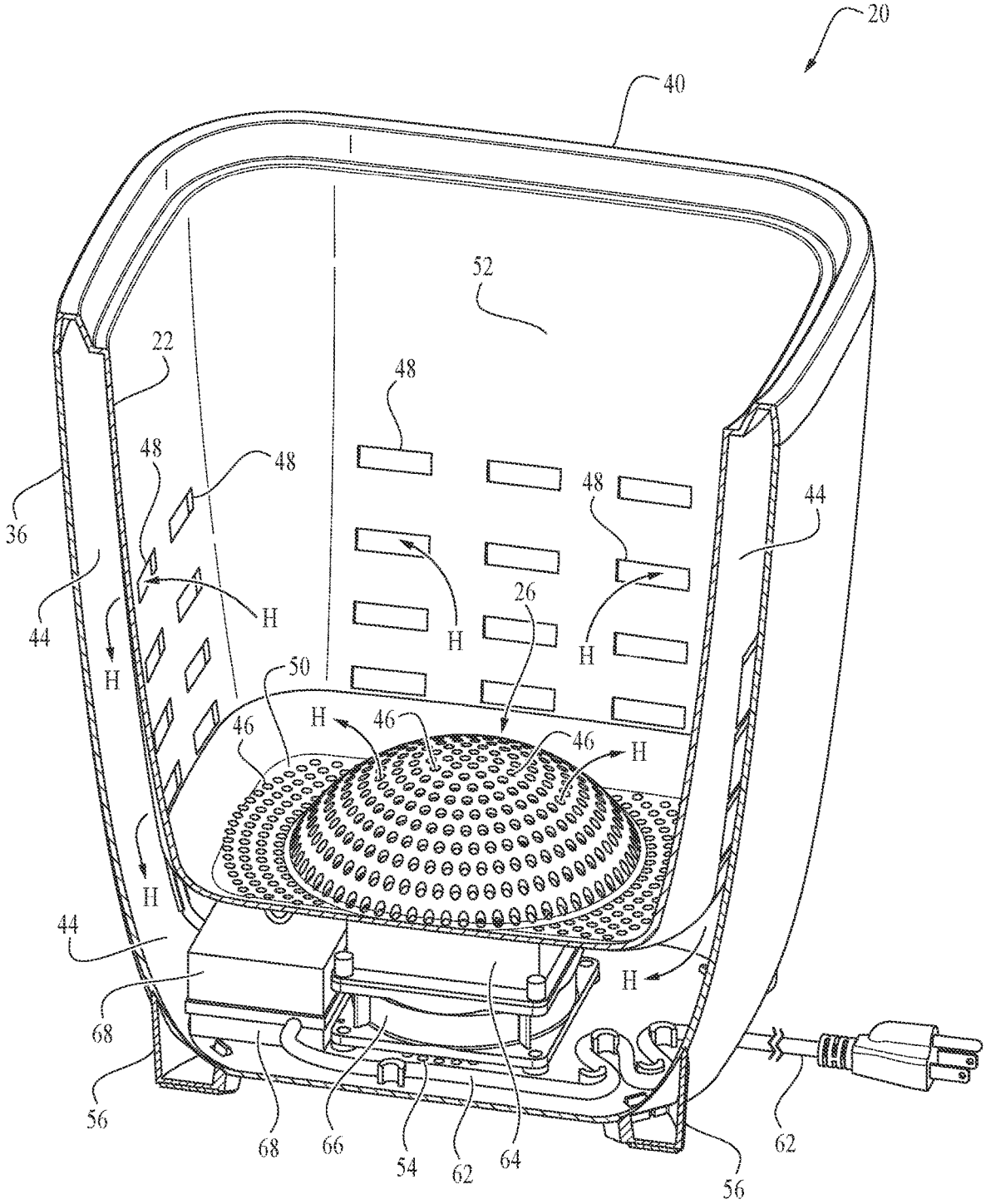
FIG. 4 is a perspective cross-sectional view of the warmer and dryer of FIG. 1.
Figure 6:
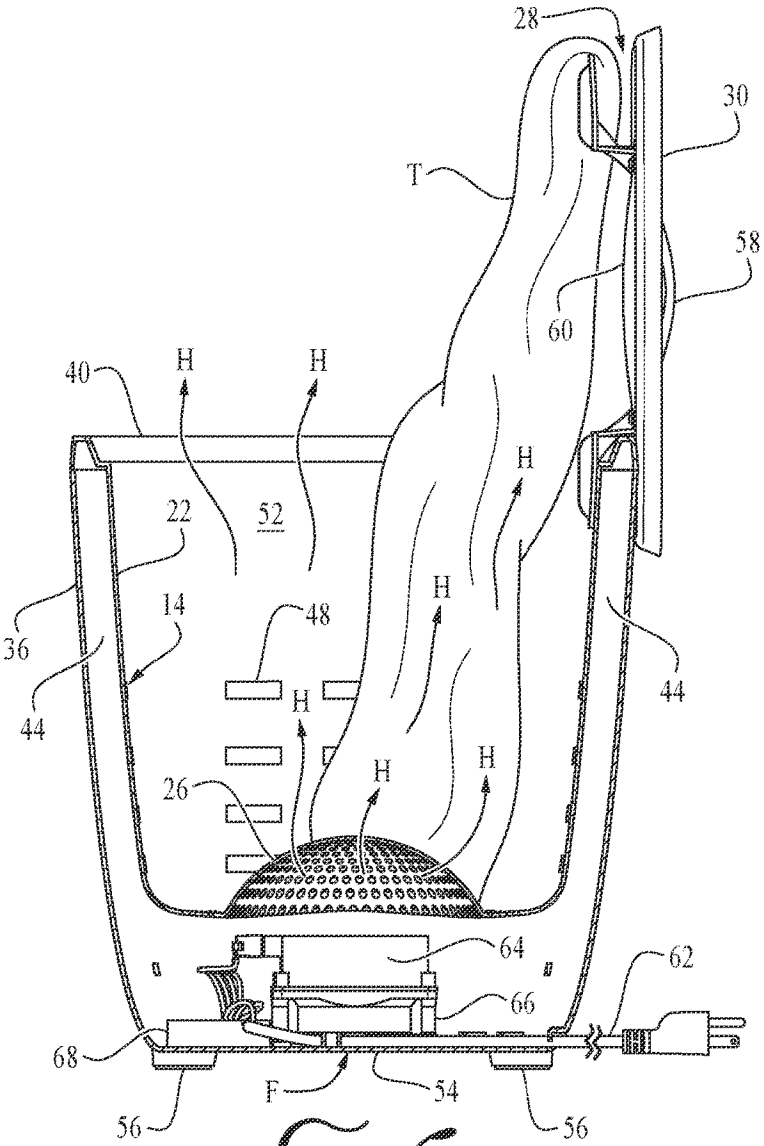
FIG. 6 is a side cross-sectional view of the warmer and dryer of FIG. 5, showing the lid in the open configuration, with the towel hanging from the fabric article hanger in a fabric article drying process.
Figure 5:
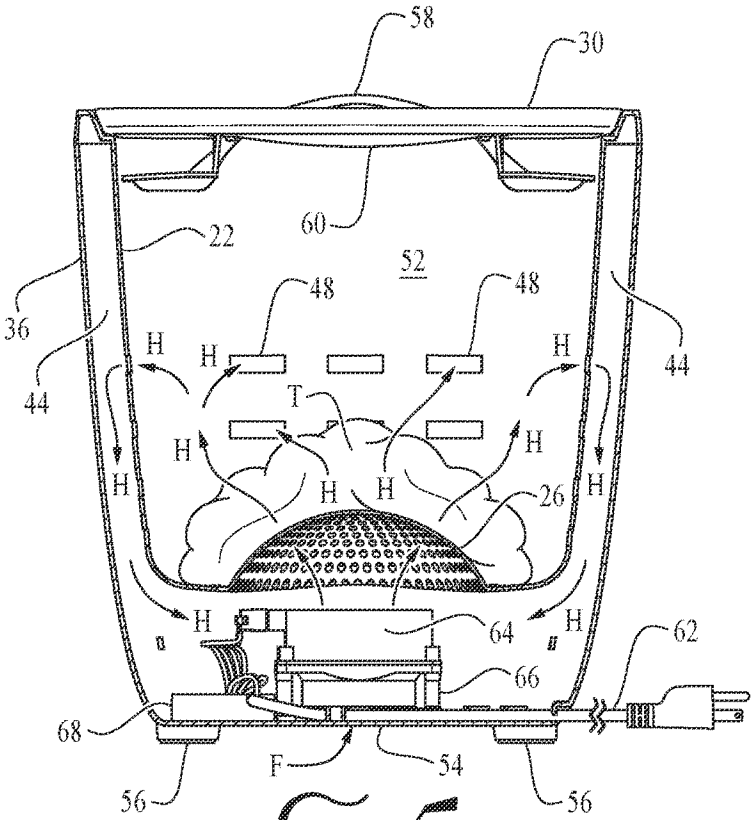
FIG. 5 is a side cross-sectional view of the warmer and dryer of FIG. 1, showing the lid in the closed configuration, with a towel warming therewithin in a fabric article heating process.

Referring first to FIGS. 1-6, an example embodiment of the present fabric article warmer and dryer 20 (which may also be referred to herein as a "towel warmer and drier" and "warmer and dryer") is illustrated, and generally includes a fabric article receptacle 22 that receives a heated air flow H from the forced heated air unit 24, a lid 30 that can be selectively opened and closed during normal operation of the warmer and dryer 20, and one or both of a protruded portion 26 and a fabric article hanger 28.

In the illustrated example embodiment, the warmer and dryer 20 includes an outer shell 36 with an inner shell 38 nested therewithin and spaced apart from the outer shell 36 delineating an air passage 44 therebetween that surrounds the side wall 52 and the bottom wall 50 of the inner shell 38. In this embodiment, the inner shell 38 defines the fabric article receptacle 22, which is configured to hold therein a fabric article (a towel T in this example). Although the fabric article is a towel T in this example, the fabric article can be any number of fabric items the user wishes to dry or warm, such as a bath robe or the like. The outer shell 36 and the inner shell 38 are coupled at the tops to define a rim 40 and an opening 42 to the fabric article receptacle 22.

One or more, or in this case, a plurality or multiplicity of heated air inlets 46 (or inner air apertures or perforations) are formed through at least a portion or most of the surface area of the bottom wall 50 and serve as a diffuser, to distribute the flow of heated air H produced by the forced heated air unit 24. Further, one or more, or in this case, a plurality of heated air outlets 48 (or second inner air apertures) are formed through the side wall 52 of the inner shell 38. One or more, or in this case, a plurality of fresh air inlets 54 are formed through the outer shell 36. Feet 56 on the bottom of the outer shell 36 creates a clearance between the floor and the fresh air inlets 54. In one or more example embodiments, the forced heated air unit 24 is mounted within the air passage 44, and draws air through the fresh air inlets 54 with a fan unit 66, across a heating element 64, and into the heated air inlets 46 of the inner shell 38. The forced heated air unit 24 receives a control signal from control circuitry 68 (such as, an on/off signal, a fan speed signal, a heating element power level signal, a timer signal, etc.) powered by cord 62, which is inputted by a user through a control panel 72. However, other means of control are possible, such as using an application on a computer, smart phone, and the like, or automatic routines automatically implemented or inputted by the user. The forced heated air unit 24 directs heated air flow H toward the heated air inlets 46, which may also entrain recirculated air as further described below. Components sensitive to direct contact with water can be covered with an enclosure to protect the control circuitry 68, the power cord 62 and associated circuitry, etc. from drips from wet towels.

In use, the heated air flow H travels through the heated air inlets 46 to interact with, for example, a towel T, which is heated and/or dried as a result, depending on the process initiated by the user. When the lid 30 is closed, the heated air flow H flows through the fabric article receptacle 22, heats the towel T, exits the fabric article receptacle 22 through the heated air outlets 48, and travels within the air passage 44. All or part of the heated air flow H can be recirculated back through the heated air inlets 46 along with newly heated air flow. When the lid 30 is removed or ajar to some degree, all, or part of the heated air flow H travels through the heated air inlets 46 and issue out of the opening 42, in a drying process, which is described in greater detail below.

The bottom wall 50 can be a substantially flat or continuous surface, or include a protruded portion 26, which can take the form of a domed portion or other appropriate shaped protuberance that extends into the fabric article receptacle 22 (i.e., a pyramid-shaped protrusion, a wedge-shaped protrusion, a conical-shaped protrusion, etc.). Here, the inner shell 38 is made of a heat resistant plastic that includes a dome 26 extending upward from the more planar surrounding portions of the bottom wall 50. The dome 26, and the surrounding portions of the bottom wall 50, includes a multiplicity of heated air inlets 46. The forced heated air unit 24 is mounted on the bottom wall of the outer shell 36, within the air passage 44, directly beneath the dome 26. The dome 26 provides spacing between the bottom wall 50 of the inner shell 38 and the heating element 64. The dome 26 increases the surface area through which the heated air flow H can act on the towel T. The dome 26 can be arranged such that the heated air inlets 46 direct the heated air flow H straight upward, normal to the dome 26, or at another desired direction, depending on the direction of the drilled holes and the other design factors. The dome 26 also provides an entrainment and mixing space for recirculated heated air and newly heated air exiting the forced heated air unit 24, when the lid 30 is closed.

A lid 30 is configured to selectively cover the opening 42 to substantially cover and seal the fabric article receptacle 22. The lid 30 includes an inner surface 32, configured to face the fabric article receptacle 22 when closed, and an outer surface 34 opposite the inner surface 32 with an handle 58 protruding from the outer surface 34 of the lid 30. When the lid 30 is seated on the rim 40, in the closed configuration, the heated air flow H is substantially recirculated, although some portion may leak out or remain static at times. Additionally, the design of the forced heated air unit 24 can permit recirculation of the heated air flow H through the forced heated air unit 24, such that the heated air flow H is reheated, resulting in a higher temperature. Further, with the lid 30 in the closed configuration, the temperature of the fabric article receptacle 22 is permitted to increase to more effectively warm the towel T stored therein.

However, as described above, if the towel T is damp and the user desires a dry towel for the next bath or shower, the lid 30 can be left at least partially open and the towel T hung with the forced heated air unit 24 turned on, so that the towel T is within the stream of the heated air flow H and is at least partially unfolded. This arrangement permits more towel T surface area exposure to the heated air flow H and exposure to the fresh air, which permits escape of moist heated air from the fabric article receptacle 22 and at least partial evaporation of the moisture from the towel T.

In one or more embodiments, the fabric article hanger 28 is a hook or other hanging device extending from the inner surface 32 of the lid 30. In the illustrated example, the fabric article hanger 28 is made integral with a bracket 60 attached to the lid 30. Here, the bracket 60 has a hat channel-like cross-sectional shape, that when attached to the lid 30, forms with the inner surface 32 two channels facing in substantially opposite directions, where each channel is configured to selectively receive either the rim 40 or act as a fabric article hanger 28. Thus, when the user opens the lid in either direction, either of the two channels 74, 76 of the bracket 60 can receive the rim 40, while the other acts as a hook for receiving the towel T. In one or more embodiments, the lid 30 can be hinged to the rim 40 by one edge, with a towel hook extending from the inner surface 32 of the lid 30. In both of these embodiments, the fabric article hanger 28 is positioned above the rim 40 when the lid 30 is in the open configuration. However, in one ore more embodiments, the fabric article hanger 28 can be positioned below rim 40, such as a hook that protrudes from the inner wall of the fabric article receptacle 22 or a rod that extends across the opening 42 that each permits the at least partial unfurling of the towel T to permit more effective, albeit not most effective, drying of the towel T. Further, in one or more embodiments, the fabric article hanger 28 can be separate from the lid 30, yet still positioned above the rim 40. For example, a telescoping mast or a fixed mast can extend upwardly from the warmer and dryer 20 with the fabric article hanger 28 positioned at or near the top end. Thus, the illustrated embodiment of the fabric article hanger 28 aspect is one of many designs that permits more effective and sanitary drying of the towel T.

A method of use, which does not require a strict order of operation and permits reversals or repeats of the steps, the user can place a fresh, dry fabric article in the fabric article receptacle 22 prior to bathing (or other activity where a warm towel, robe, blanket, etc. is desired). The user sets a time and, optionally, a temperature/power level using the control panel 72. In one or more example embodiments, the control panel 72 could include a several buttons that include an off button, a first-time duration, a second time duration, a third time duration, and so on (i.e., durations of 10 minutes, 20 minutes, 30 minutes, etc.). Further, the control circuitry 68 can include instructions with operational parameters for the forced heated air unit 24 which vary according to whether the lid 30 is open or closed. For example, the fan unit 66 speed can be increased when the lid 30 is opened to increase air flow incident on the towel T. When the time duration selected has ended, the forced heated air unit 24 can turn off or merely maintain a preprogrammed temperature and/or flow rate in a low power state. The user can retrieve the warmed towel T for use, for example, to dry oneself.

Further, once the user is finished with the towel T, the damp towel can be immediately hung on the fabric article hanger 28, with the lid 30 in the open configuration, and the forced heated air unit 24 switched on continuously or for a selected time duration in the drying process. In this example, the towel T is partially positioned above the rim 40 and partially within the fabric article receptacle 22, either freely hanging or partially resting on the bottom wall 50 and the protruded portion 26. The towel T can be left in the hanging position once the time duration has expired, awaiting the next use. It has been found that, with the present warmer and dryer 20, there will be an approximately 60% to 70% reduction in towel moisture in 15 minutes, while the remaining moisture will evaporate before the next use, and as the surrounding atmosphere permits. When the user once again starts to bathe, the dried towel T can be dropped into the fabric article receptacle 22 with the lid 30 on, to be heated once again in the warming process. Alternatively, the user may decide to initially heat the moist towel T by placing it in the fabric article receptacle 22 with the lid 30 on for a selected duration. Once the moist towel T has been heated for a defined period of time (i.e., for 10 to 30 minutes) insufficient for substantial bacteria growth, the user can open the lid 30, hang the lid 30 on the rim 40, and with the forced heated air unit 24 on, permit the towel T to dry in the hanging configuration, as described above.

Aspects of the present specification may also be described by the following embodiments:

1. A warmer and dryer of a fabric article comprising an outer shell having an outer air aperture formed therethrough; an inner shell defining a fabric article receptacle therewithin and having a protruded portion of the inner shell protruding into the fabric article receptacle with an inner air aperture formed through the protruded portion, the inner shell being spaced apart and nested within the outer shell defining an air passage therebetween; and a forced heated air unit providing fluid communication between the outer air aperture and the inner air aperture to provide a flow of heated air to the inner aperture and therethrough to the fabric article receptacle.

2. The warmer and dryer of embodiment 1, wherein the inner air aperture and the protruded portion are positioned on a bottom wall of the inner shell and a second inner air aperture is formed through a side wall of the inner shell.
3. The warmer and dryer of embodiments 1 or 2, wherein the flow of heated air generally enters the fabric article receptacle through the inner air aperture and exits the fabric article receptacle through the second inner air aperture, flowing into the air passage thereafter.
4. The warmer and dryer of any one of embodiments 1-3, wherein at least a portion of the flow of heated air originating from the air passage is entrained into the flow of heated air originating from the forced heated air unit.
5. The warmer and dryer of any one of embodiments 1-4, wherein the forced heated air unit comprises a heating element and a fan unit mounted within the air passage and configured to receive outside air through the outer air aperture and to direct the flow of heated air to the inner air aperture.
6. The warmer and dryer of any one of embodiments 1-5, wherein the protruded portion is a dome protruding into the fabric article receptacle from a bottom wall of the inner shell.
7. The warmer and dryer of any one of embodiments 1-6, wherein the protruded portion includes a plurality of inner air apertures distributed over an area of the protruded portion.
8. The warmer and dryer of any one of embodiments 1-7, wherein the inner shell and the outer shell coupled about a rim.
9. The warmer and dryer of any one of embodiments 1-8, further comprising a fabric article hanger, wherein in an open configuration, when a lid is at least partially open to expose the fabric article receptacle to outside air, the fabric article hanger is configured to hang thereon the article of fabric hanging toward the fabric article receptacle enabling selective exposure to the flow of heated air in a drying process.
10. The warmer and dryer of any one of embodiments 1-9, the fabric article hanger is positioned on the lid.
11. The warmer and dryer of any one of embodiments 1-10, wherein an opening to the fabric article receptacle is defined by the inner shell and the outer shell, a lid is removably fitted to the opening, the lid comprising a rim bracket selectively receiving a rim about the opening to hang the lid on the rim in an open configuration where the lid is at least partially open to expose the fabric article receptacle to outside air.
12. A warmer and dryer of a fabric article comprising an outer shell having a fresh air inlet formed therethrough; an inner shell defining a fabric article receptacle therewithin and having a protruded portion of the inner shell protruding from a bottom wall of the inner shell and protruding into the fabric article receptacle with a heated air inlet formed through the protruded portion, a heated air outlet is formed through a side wall of the inner shell, the inner shell being spaced apart and nested within the outer shell defining an air passage therebetween; an opening to the fabric article receptacle delineated by a rim formed by the inner shell and the outer shell; a lid selectively covering the opening in a closed configuration; a forced heated air unit comprising a heating element and a fan unit and providing fluid communication between the fresh air inlet and the heated inner air to provide a flow of heated air to the heated air inlet and therethrough to the fabric article receptacle; and a fabric article hanger, when in an open configuration where a lid is at least partially open to expose the fabric article receptacle to outside air, the fabric article hanger is configured to hang thereon the fabric article hanging toward the fabric article receptacle enabling selective exposure to the flow of heated air traveling through the opening in a fabric article drying process; wherein, in the closed configuration, the flow of heated air travels through the heated air outlet and into the air passage, at least a portion of the flow of heated air originating from the air passage is entrained into the flow of heated air originating from the forced heated air unit in a fabric article heating process.
13. The warmer and dryer of embodiment 12, wherein the fabric article hanger is positioned on the lid.
14. The warmer and dryer of embodiments 12 or 13, wherein the lid comprises a rim bracket selectively receiving the rim to hang the lid on the rim in the open configuration.
15. The warmer and dryer of any one of embodiments 12-14, wherein the protruded portion is a dome protruding into the fabric article receptacle from the bottom wall of the inner shell.
16. A warmer and dryer of a fabric article comprising a fabric article receptacle having a heated air inlet and an opening to the fabric article receptacle delineated by a rim; a lid selectively covering the opening in a closed configuration; a forced heated air unit providing a flow of heated air to the heated air inlet and into the fabric article receptacle; and a fabric article hanger being positioned above the rim in at least an open configuration; wherein, in the open configuration where the lid is at least partially open, the fabric article hanger is configured to selectively hold the fabric article at least partially above the rim to permit exposure thereof to the flow of heated air and outside air in a fabric article drying process; and wherein, in the closed configuration, the fabric article receptacle is configured to selectively contain the fabric article therein, with the flow of heated air directed through the heated air inlet and into the fabric article receptacle to permit exposure of the fabric article to the flow of heated air in a fabric article heating process.
17. The warmer and dryer of embodiment 16, wherein further comprising an outer shell having a fresh air inlet formed therethrough; and an inner shell defining the fabric article receptacle therewithin and having a protruded portion of the inner shell protruding from a bottom wall of the inner shell and protruding into the fabric article receptacle with the heated air inlet formed through the protruded portion, a heated air outlet is formed through a side wall of the inner shell, the inner shell being spaced apart and nested within the outer shell defining an air passage therebetween, the air passage provides fluid communication between the heated air inlet and the heated air outlet; the flow of heated air is directed through the heated air outlet and into the air passage, at least a portion of the flow of heated air originating from the air passage is entrained into the flow of heated air originating from the forced heated air unit in a fabric article heating process.
18. The warmer and dryer of embodiments 16 or 17, wherein the protruded portion is a dome protruding into the fabric article receptacle from the bottom wall.

19. The warmer and dryer of any one of embodiments 16-18, wherein the lid further comprises the fabric article hanger, when the lid is opened the fabric article hanger is positioned above the rim.
20. The warmer and dryer of any one of embodiments 16-19, wherein the lid further comprises a rim bracket protruding from the lid, the rim bracket being configured to selectively receive the rim in the open configuration.

In closing, foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions, and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions, and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step, or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps or limitations may be made for any one of the elements, steps or limitations in a claim set forth below or that a single element, step, or limitation may be substituted for two or more elements, steps, or limitations in such a claim. Although elements, steps or limitations may be described above as acting in certain combinations and even initially claimed as such, it is to be expressly understood that one or more elements, steps or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more, or different elements, steps and/or limitations, which are disclosed in above even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In an analogous manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A warmer and dryer of a fabric article comprising:

an outer shell having an outer air aperture formed therethrough;

an inner shell defining a fabric article receptacle therewithin and having a protruded portion of the inner shell protruding into the fabric article receptacle with an inner air aperture formed through the protruded portion, the inner shell being spaced apart and nested within the outer shell defining an air passage therebetween; and a forced heated air unit providing fluid communication between the outer air aperture and the inner air aperture to provide a flow of heated air to the inner air aperture and therethrough to the fabric article receptacle, wherein an opening to the fabric article receptacle is defined by the inner shell and the outer shell, a lid is removably fitted to the opening, the lid comprising a rim bracket selectively receiving a rim about the opening to hang the lid on the rim in an open configuration where the lid is at least partially open to expose the fabric article receptacle to outside air.

2. The warmer and dryer of claim 1, wherein the inner air aperture and the protruded portion are positioned on a bottom wall of the inner shell and a second inner air aperture is formed through a side wall of the inner shell.

3. The warmer and dryer of claim 2, wherein the flow of heated air generally enters the fabric article receptacle through the inner air aperture and exits the fabric article receptacle through the second inner air aperture, flowing into the air passage thereafter.

4. The warmer and dryer of claim 3, wherein at least a portion of a flow of heated air originating from the air passage is entrained into the flow of heated air originating from the forced heated air unit.

5. The warmer and dryer of claim 1, wherein the forced heated air unit comprises a fan unit mounted within the air passage and configured to receive outside air through the outer air aperture and to direct the flow of heated air to the inner air aperture.

6. The warmer and dryer of claim 1, wherein the protruded portion is a dome protruding into the fabric article receptacle from a bottom wall of the inner shell.

7. The warmer and dryer of claim 1, wherein the protruded portion includes a plurality of inner air apertures distributed over an area of the protruded portion.

8. The warmer and dryer of claim 1, wherein the inner shell and the outer shell coupled about a rim.

9. The warmer and dryer of claim 1, further comprising a fabric article hanger, wherein in an open configuration, when a lid is at least partially open to expose the fabric article receptacle to outside air, the fabric article hanger is configured to hang thereon the article of fabric hanging toward the fabric article receptacle enabling selective exposure to the flow of heated air in a drying process.

10. The warmer and dryer of claim 1, wherein the fabric article hanger is positioned on the lid.

11. A warmer and dryer of a fabric article comprising:

an outer shell having a fresh air inlet formed therethrough;

an inner shell defining a fabric article receptacle therewithin and having a protruded portion of the inner shell protruding from a bottom wall of the inner shell and protruding into the fabric article receptacle with a heated air inlet formed through the protruded portion, a heated air outlet is formed through a side wall of the inner shell, the inner shell being spaced apart and nested within the outer shell defining an air passage therebetween;

an opening to the fabric article receptacle delineated by a rim formed by the inner shell and the outer shell;

a lid selectively covering the opening in a closed configuration;

a forced heated air unit comprising a fan unit and providing fluid communication between the fresh air inlet and a heated inner air to provide a flow of heated air to the heated air inlet and therethrough to the fabric article receptacle; and a fabric article hanger, when in an open configuration where the lid is at least partially open to expose the fabric article receptacle to outside air, the fabric article hanger is configured to hang thereon the fabric article hanging toward the fabric article receptacle enabling selective exposure to the flow of heated air traveling through the opening in a fabric article drying process;

wherein, in the closed configuration, the flow of heated air travels through the heated air outlet and into the air passage, at least a portion of the flow of heated air originating from the air passage is entrained into the flow of heated air originating from the forced heated air unit in a fabric article heating process, and wherein the lid comprises a rim bracket selectively receiving the rim to hang the lid on the rim in the open configuration.

12. The warmer and dryer of claim 11, wherein the fabric article hanger is positioned on the lid.

13. The warmer and dryer of claim 11, wherein the protruded portion is a dome protruding into the fabric article receptacle from the bottom wall of the inner shell.

14. A warmer and dryer of a fabric article comprising:

a fabric article receptacle having a heated air inlet and an opening to the fabric article receptacle delineated by a rim;

a lid selectively covering the opening in a closed configuration;

a forced heated air unit providing a flow of heated air to the heated air inlet and into the fabric article receptacle; and a fabric article hanger being positioned above the rim in at least an open configuration;

wherein, in the open configuration where the lid is at least partially open, the fabric article hanger is configured to selectively hold the fabric article at least partially above the rim to permit exposure thereof to the flow of heated air and outside air in a fabric article drying process;

wherein, in the closed configuration, the fabric article receptacle is configured to selectively contain the fabric article therein, with the flow of heated air directed through the heated air inlet and into the fabric article receptacle to permit exposure of the fabric article to the flow of heated air in a fabric article heating process, and wherein the lid further comprises a rim bracket protruding from the lid, the rim bracket being configured to selectively receive the rim in the open configuration.

15. The warmer and dryer of claim 14, wherein the fabric article receptacle further comprising:

an outer shell having a fresh air inlet formed therethrough; and an inner shell defining the fabric article receptacle therewithin and having a protruded portion of the inner shell protruding from a bottom wall of the inner shell and protruding into the fabric article receptacle with the heated air inlet formed through the protruded portion, a heated air outlet is formed through a side wall of the inner shell, the inner shell being spaced apart and nested within the outer shell defining an air passage therebetween, the air passage provides fluid communication between the heated air inlet and the heated air outlet;

the flow of heated air is directed through the heated air outlet and into the air passage, at least a portion of the flow of heated air originating from the air passage is entrained into the flow of heated air originating from the forced heated air unit.

16. The warmer and dryer of claim 14, wherein the protruded portion is a dome protruding into the fabric article receptacle from the bottom wall.

* * * * *